US008484873B2

(12) United States Patent
Splittgerber

(10) Patent No.: US 8,484,873 B2
(45) Date of Patent: Jul. 16, 2013

(54) FRONT-LOADING DISPLAY SYSTEM

(76) Inventor: Ute Splittgerber, South San Francisco, CA (US)

( * ) Notice: Subject to any disclaimer, the term of this patent is extended or adjusted under 35 U.S.C. 154(b) by 1015 days.

(21) Appl. No.: 11/713,357

(22) Filed: Mar. 1, 2007

(65) Prior Publication Data

US 2007/0204500 A1 Sep. 6, 2007

Related U.S. Application Data

(60) Provisional application No. 60/778,826, filed on Mar. 3, 2006.

(51) Int. Cl.
*A47G 1/06* (2006.01)

(52) U.S. Cl.
USPC ..... 40/781; 40/711

(58) Field of Classification Search
USPC ..... 40/711, 737, 771
See application file for complete search history.

(56) References Cited

U.S. PATENT DOCUMENTS

| | | | | |
|---|---|---|---|---|
| 5,102,600 | A * | 4/1992 | Ekiner et al. | 264/177.15 |
| 5,269,083 | A * | 12/1993 | Vampatella et al. | 40/711 |
| 5,396,999 | A * | 3/1995 | Sandheinrich | 206/542 |
| 6,868,630 | B2 | 3/2005 | Kim | |
| 2003/0121193 | A1 | 7/2003 | Kim | |
| 2004/0111944 | A1 | 6/2004 | Gatt et al. | |

* cited by examiner

*Primary Examiner* — Joanne Silbermann
*Assistant Examiner* — Shin Kim

(57) ABSTRACT

The subject matter of the current invention is directed to a front-loading display system adapted for safe, frequent, and rapid change of displayed objects. The display system includes a base and an object-holding assembly. The object-holding assembly can be releasably attached to the base through the use of a fastener, which allows the base to remain mounted to a mounting surface when changing display objects. In a preferred embodiment, the fastener employs magnetic force to connect the base and the object-holding assembly. The display object is retained between a resting plate and a cover plate, the two plates being releasably attached to each other by the use of at least one holding device, which may be selected from clips, clasps, hinges and elastic bands.

22 Claims, 10 Drawing Sheets

FRONT-LOADING DISPLAY SYSTEM

CROSS REFERENCE TO RELATED APPLICATIONS

This application claims priority under 35 U.S.C. §119(e) to U.S. Provisional Patent Application No. 60/778,826 filed Mar. 3, 2006, which is incorporated herein by reference in its entirety for all purposes.

BACKGROUND OF THE INVENTION

A wide variety of picture frames exist. Known picture frames typically include a frame, a transparent lens and a backing, which is mounted to the frame in order to retain the artwork between the backing and the lens. The backing is typically a heavy cardboard, and optionally includes a hinged leg for upright display on a horizontal support, such as a tabletop. The backing or frame commonly includes wall-mounting means such as metal loops or wire for mounting over a picture hanger (e.g., a hook), a nail or a screw driven into the wall.

Conventional picture frames are loaded from the backside by removing the backing, placing the artwork on the clear lens and re-attaching the backing. Such picture frames often bear safety issues and are not designed for straight-forward assembly and disassembly, which prevents them from being used by children. This is especially true for wall-mounted picture frames, which must typically be removed from the wall when changing displayed artwork thereby exposing hangers, nails or screws. The glass lens frequently used in known picture frames presents an additional hazard during assembly and use.

In known picture frames, the backing is commonly held in place by flat metal tabs, which are attached to the frame and can be pivoted over the backing. These tabs frequently break off or come loose, rendering the assembly less useful. In addition, such tabs often contain sharp edges, which may cause injury to the user.

Other back-loading picture frames, employ a number of separate attachment devices, such as spring clasps, which are adapted to engage the frame thereby holding the backing against the frame. Each time artwork is inserted into the picture frame the clasps have to be removed, which typically requires significant pressure to be applied. As a result, such fastening mechanism is not suitable for use by children.

Front-loading picture frames have been described, e.g. in U.S. Pat. No. 6,868,630 to Kim, U.S. Patent Application No. 2004/0111944, U.S. Patent Application No. 2005/0028417 and U.S. Patent Application No. 2003/0121193. The described picture frames each include a backing member, which can be mounted to a vertical mounting surface, and could theoretically stay mounted when changing artwork. However, the artwork must be placed on the mounted backing member and be held in place while attaching other frame elements, which is most practically done by taking the device off the wall and placing it into a horizontal position. In this respect, the known devices offer little advantage over traditional picture frames. The inventors of U.S. Patent Application No. 2004/0111944 have realized the shortcoming and offer solutions, such as the use of elastic bands, which hold the artwork against the backing member. However, even when using the described aids, it is cumbersome to position a non-rigid picture onto a vertical surface, especially if the picture frame is mounted at a difficult to reach location. In addition, the required procedure may damage the artwork.

Thus, a continuing need exists for a display system that can be safely, quickly and repeatedly assembled and disassembled without the requirement for removing wall-mounted parts and without compromising the quality of the displayed object. The present invention addresses these and other needs.

SUMMARY OF THE INVENTION

In a first aspect, the present invention provides a display system including: (a) a base having a rear surface and an opposing support surface. In one example, the base includes a mounting device for mounting the base to a vertical or horizontal mounting surface. The display system of the invention further includes (b) an object-holding assembly including (i) a cover plate, (ii) a resting plate having a support surface and an opposing rear surface, and (iii) one or more holding device for releasably attaching the cover plate to the resting plate. Exemplary holding devices include clips (e.g., binder clips), braces, clasps, corner casts and elastic bands. In another example, the two plates are hingedly connected to each other alongside one edge, so that the resulting assembly can be opened and closed for placement of a display object between the plates. In a preferred embodiment, the display system also includes (c) a fastener for releasably attaching the object-holding assembly to the base. An exemplary fastener includes two or more magnets.

In a preferred embodiment, the current display system allows the user to quickly and frequently change displayed objects. In another preferred embodiment, the present display system offers improved safety features over existing devices. Together these characteristics make it possible for the present invention to be used by children and may also offer advantages for people with certain disabilities.

Other features and advantages of the present invention will become better understood with reference to the accompanying drawings and the detailed description that follows.

BRIEF DESCRIPTION OF THE DRAWINGS

In FIG. 5A the counter-attachment pieces are partially embedded into the resting plate. In FIG. 5B the counter-attachment pieces are fully embedded into the resting plate.

In FIG. 6B, the resting plate 12 provides a flat opening into which the cover plate 11 is inserted, optionally retaining a display object 16 between the two plates.

DETAILED DESCRIPTION OF THE INVENTION AND THE PREFERRED EMBODIMENTS

I. Introduction

Figure 1:
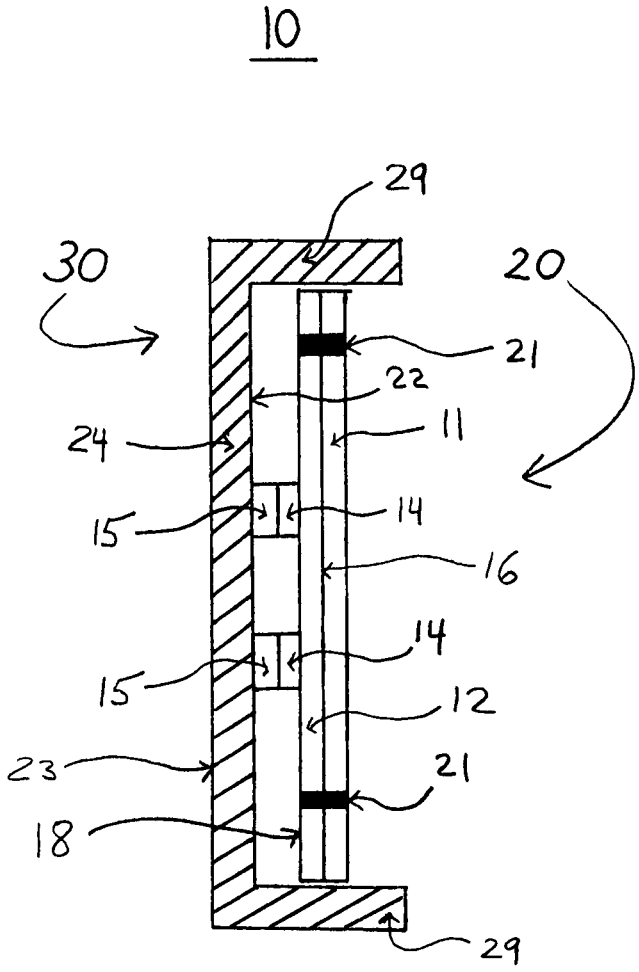
FIG. 1 is a cutaway side view of an exemplary display system 10 having a fastener that includes at least two attachment pieces 15 attached to the support surface 22 of the base 30 and at least two counter-attachment pieces 14 attached to the rear surface 18 of the resting plate 12. The figure further illustrates an exemplary base 30, having at least two side panels 29. An exemplary object-holding assembly includes a resting plate 12, a cover plate 11 and holding devices 21 (shown schematically), which are used to releasably attach the resting plate and the cover plate to each other. A display object 16 is indicated between the resting plate and the cover plate.

The present invention provides a front-loading display system including a base and an object-holding assembly. In a preferred embodiment, the object-holding assembly can be releasably attached to the base using a fastener described herein. A preferred fastener employs magnetic force. An exemplary object-holding assembly includes a resting plate and a cover plate and optionally a display object, which is placed between the resting plate and the cover plate. The resting plate and the cover plate are releasably attached to each other using one or more holding device. An exemplary holding device is selected from clips, clasps, clamps, braces, hinges, elastic bands, corner casts and the like.

The display system of the invention offers a variety of advantages over traditional picture frames as well as known, front-loading devices. One advantage is that the base does not need to be removed from the mounting surface (e.g., a wall) in order to add, change or remove the display object. As a result, the base can be mounted to the mounting surface in a more permanent fashion when compared to back-loading picture frames. In addition, hangers, nails, screws or other mounting devices do not need to be exposed when changing artwork. The object-holding assembly can be entirely removed from the base and re-attached after the display object has been changed. Once the object-holding assembly is removed from the base, its assembly and disassembly can be performed in a convenient manner. For example, the object-holding assembly can be placed on a horizontal surface, facilitating optimal positioning of the display object. A further advantage is that the display object is essentially not in direct contact with the base, but instead is separated from the base by the resting plate and retained between the resting plate and the cover plate. Potential damage to the display object is thus less likely.

II. The Display System

In a first aspect, the present invention provides a display system 10 including: (a) a base 30 having a rear surface 23 and an opposing support surface 22, separated by a side edge 24, (b) an object-holding assembly 20, including (i) a cover plate 11, (ii) a resting plate 12 having a support surface 17 and an opposing rear surface 18, separated by a side edge 19, and (iii) one or more holding device 21 for releasably attaching the cover plate 11 to the resting plate 12. The object-holding assembly is adapted for placement of a display object between the resting plate and the cover plate. In a preferred embodiment, the display system of the invention further includes (c) a fastener for releasably attaching the object-holding assembly to the base.

The display system of the invention can have any size and shape. In one embodiment, the base, the resting plate and the cover plate are each independently shaped. For example, the base, the resting plate and the cover plate may, independently, be rectangular, square, oval, round, heart-shaped or irregularly shaped. In another embodiment, the base of the display system is part of another object, such as a container, a piece of furniture, a toy and the like. In an exemplary embodiment, the cover plate, the resting plate and the support surface of the base are substantially flat. In another exemplary embodiment, the cover plate, the resting plate and the support surface of the base are substantially curved. A curved structure may arise from including the base into a curved object, such as a bulbous vase or toy.

Fastener

In a preferred embodiment, the display system of the invention includes a fastener, which is used to releasably attach the object-holding assembly to the base. The fastener can be any device or mechanism known in the art useful for releasably attaching one object to another. It is well within the abilities of a skilled person to choose a fastener depending on given parameters, such as size, weight and material of both the base and the object-holding assembly as well as the intended type of use for the display system.

In one embodiment, the fastener is attached to the base, e.g., to a side panel of the base and is useful to engage the plates of the object-holding assembly. For example, the fastener may include a spring-loaded fastener, such as a ball plunger.

In another embodiment, the fastener includes an attachment piece 15 and a counter-attachment piece 14. In one embodiment, the base 30 includes the attachment piece and the object-holding assembly 20 includes the counter-attachment piece. In this embodiment, the attachment piece and the counter-attachment piece releasably engage when the object-holding assembly is being attached to the base. In one example according to this embodiment, the base itself or parts of the base, such as the support surface can constitute the attachment piece. For example, when the base is made from ferromagnetic metal, a separate ferromagnetic attachment piece may not be needed. In another example, a part of the object-holding assembly, such as the resting plate or the holding device can constitute the counter-attachment piece. For example, the holding device can be a ferromagnetic clip, or the resting plate may be made from a ferromagnetic metal.

The attachment piece and the counter-attachment piece include materials, which make it possible for the attachment piece and the counter-attachment piece to releasably engage each other. In one embodiment, the attachment piece and the counter-attachment piece independently include a material selected from the group consisting of magnets (preferably permanent magnets), ferromagnetic material, hook parts of hook-and-loop fasteners, loop parts of hook-and-loop fasteners (e.g., Velcro and velcro-like material), parts of snap fasteners (e.g., male or female discs of snap fasteners), reversibly adhesive materials, suction devices, holes, pins, hangers (e.g., sawtooth hangers, bars), hooks, loops, string, wire and combinations thereof. It is well within the abilities of a skilled person to select, and position within the base and the object-holding assembly, complementary attachment pieces and counter-attachment pieces to create a useful fastener of the invention. For example, when the counter-attachment piece is a suction cup, the base can include a complementary smooth surface.

The display system of the invention can include any number of attachment pieces and counter-attachment pieces. In a preferred embodiment, the display system includes from 1 to about 10 attachment pieces and from 1 to about 10 counter-attachment pieces.

More preferably the display system includes from 1 to about 8, even more preferably from 1 to about 6 and most preferably from 1 to about 4 of each of the attachment pieces and the counter-attachment pieces.

In a preferred embodiment, the one or more attachment piece 15 and the one or more counter-attachment piece 14 are arranged in a way that they are not visible when the viewer is facing the fully assembled display system 10. In one embodiment, the dimensions of the display object 16, placed between the cover plate 11 and the resting plate 12, are such that the display object covers the area of the base and the object-holding assembly where the attachment pieces and counter-attachment pieces are located. In another embodiment, the resting plate 12 is non-transparent or includes a non-transparent part, wherein the non-transparent portion of the resting plate has dimensions sufficient to cover the counter-attachment pieces as well as the area of the base 30 where the attachment pieces 15 are located. In this context, "to cover" means that the attachment pieces and counter-attachment pieces are not visible, when the viewer faces the display system 10 from the front (i.e., because they are hidden behind the display object or the non-transparent part of the resting plate).

Fastener Utilizing Magnets

In one embodiment, the fastener utilizes magnetism and includes one or more magnet, preferably from about 2 to about 12 magnets. In an exemplary embodiment, the attachment piece of the base includes a magnet while the counter-attachment piece of the object-holding assembly includes a ferromagnetic metal, such as steel. In another exemplary embodiment, the attachment piece of the base includes a ferromagnetic material, while the counter-attachment piece of the object-holding assembly includes a magnet. In one example, the base is essentially made from ferromagnetic material, such as a magnetic metal (preferably non-corrosive metal). In another example, both the base as well as the object-holding assembly include one or more magnet. In each case, magnets and ferromagnetic materials are positioned and oriented to allow for the attachment piece and the counter attachment piece to engage through magnetic force when the object-holding assembly is being attached to the base.

Magnets used with a fastener of the invention can have any size, shape and grade. Useful magnets include, for example, industrial grade permanent magnets and rare earth neodymium magnets, such as NdFeB magnets. In an exemplary embodiment, the magnets have a shape, which is a member selected from discs, plates, rods, cubes, rings and the like. In a preferred embodiment, the magnets are of sufficient strength and size for the object-holding assembly to be securely fastened to the base. Strength and size of the magnets is, in part, dependent on the size and weight of the object-holding assembly and on whether or not the weight of the object-holding assembly is otherwise supported, for example through the use of one or more supporting device described herein.

In one embodiment, the magnetic fastener includes male and female parts, such as those of a snap fastener. In one example according to this embodiment, the fastener includes a magnetic snap fastener. Exemplary magnetic snap fasteners are disclosed in U.S. Pat. Nos. 5,722,126 and 5,933,926 issued to Reiter, U.S. Pat. Nos. 4,453,294 and 4,021,891 to Morita, UK Patent 1,519,246 as well as U.S. Pat. No. 6,892,428, the disclosures of which are incorporated herein by reference for all purposes. Magnetic snap fasteners are particularly useful within the current invention because male and female elements of these devices engage in a way that can prevent downward sliding of the object-holding assembly caused by gravity. This may be particularly important when the weight of the object-holding assembly is not supported by either a side panel of the base or by any supporting means. In addition, such magnets can help to accurately position the object-holding assembly since the male and female parts typically engage only when accurately positioned. Alternatively, the fastener includes a first magnet, which includes a cavity and a second magnet, which includes a protrusion that fits into the cavity of the first magnet. One of the two magnets may alternatively be replaced with a ferromagnetic material of the same shape.

Hook and Loop Fastener

In another embodiment, the fastener includes a hook and loop fastener. For example, the attachment piece of the base includes the loop part of the hook-and-loop fastener, while the counter-attachment piece of the object-holding assembly includes a complementary hook part of the hook-and-loop fastener. In another example, the attachment piece of the base includes the hook part of the hook-and-loop fastener, while the counter-attachment piece of the object-holding assembly includes a complementary loop part of the hook-and-loop fastener. Both parts of the fastener are selected and positioned so that the base and the object-holding assembly effectively engage, when the object-holding assembly is being attached to the base. In one example according to this embodiment, the support surface of the base is covered or partially covered with a velcro-like material.

Attachment Piece (15)

Figure 7A:
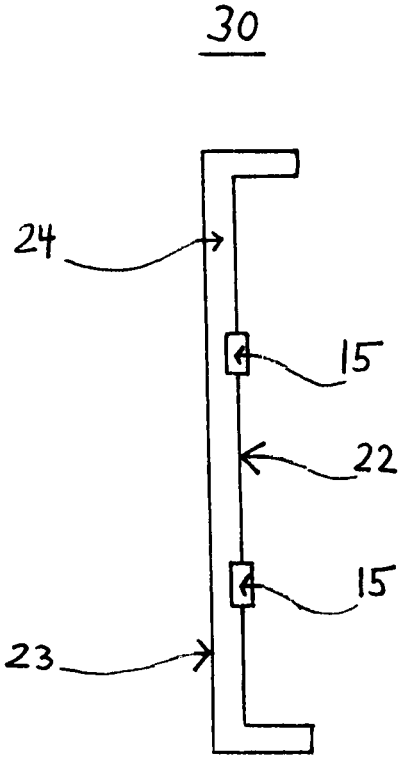
FIG. 7A and FIG. 7B are cutaway side views of the base 30 illustrating embodiments of attachment pieces 15 (7A: attachment pieces are partially embedded into the support surface of the base; 7B: attachment pieces are fully embedded into the base).
Figure 7B:
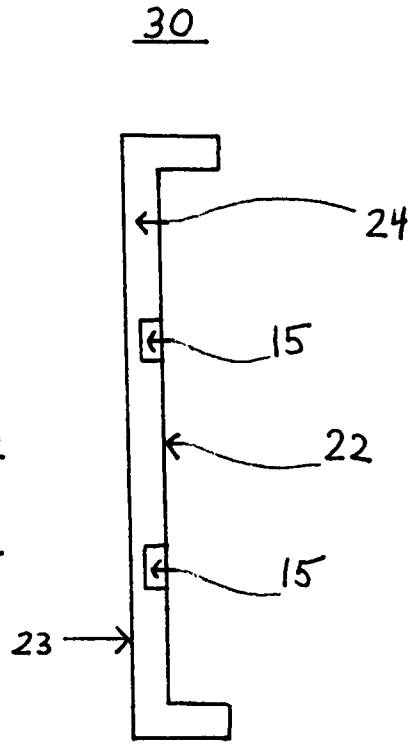

In one embodiment, the base 30 includes one or more attachment piece 15. For example, each attachment piece, independently, is either part of the base or is attached to the support surface 22 of the base. In an exemplary embodiment, the attachment piece is partially embedded into the support surface of the base as illustrated in FIG. 7A. In another exemplary embodiment, the attachment piece is fully embedded into the support surface of the base as illustrated in FIG. 7B. In one example, the attachment piece is embedded into the base in order to facilitate the attachment of the attachment piece to the support surface of the base (e.g., by glueing). In another example, the attachment piece is embedded into the base to reduce the distance between the support surface of the base and the object-holding assembly, when the object-holding assembly is attached to the base.

Figure 8:
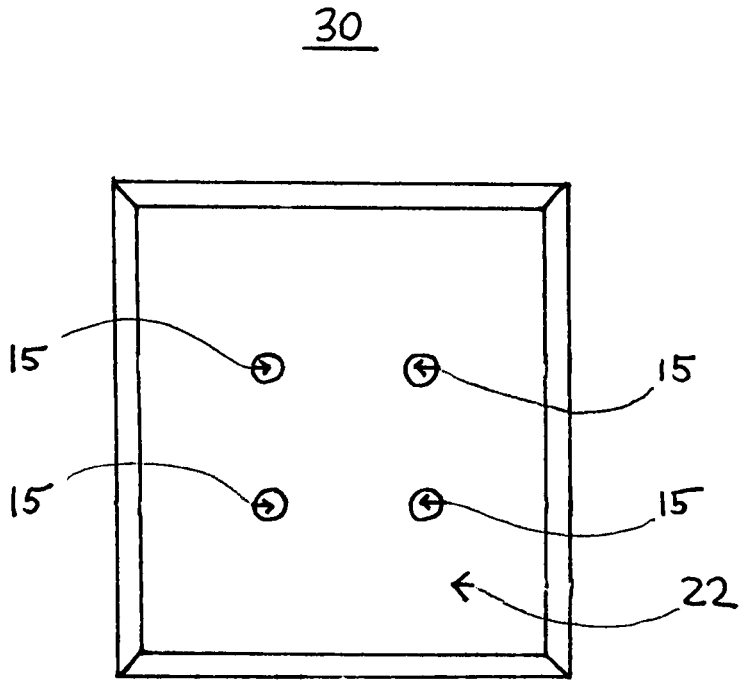
FIG. 8 is a front view of the base 30 illustrating an embodiment, wherein a number of attachment pieces (4 shown) are positioned in the center area of the support surface 22 of the base.

In an exemplary embodiment, 1 to about 6, preferably 2 to about 4 attachment pieces 15 are arranged in the center area of the support surface 22 of the base, for example, as illustrated in FIG. 8.

A variety of methods can be used to attach the attachment piece to the support surface of the base. To select a suitable method, one may consider the size and weight as well as the material of the base and the attachment piece. In an exemplary embodiment, in which the base is metal and the attachment piece is also metal, the attachment piece may be attached to the base by means of soldering or welding. In another exemplary embodiment, the attachment piece and the support surface of the base are connected using glue. It is within the abilities of a skilled artisan to select a suitable glue depending on the materials of the base and the attachment piece. In an exemplary embodiment, the glue is a member selected from commercial glues, such as silicon-based glues, contact adhesives, sealants, two-component glues and the like.

In another exemplary embodiment, the attachment piece is attached to the base using screws, nails, nuts and bolts, staples and the like. For larger display systems (e.g., dimensions larger than 1×1 meter), the hardware suitable for the connection of the attachment pieces to the base may include screws or bolts.

Counter-Attachment Piece (14)

Figure 5A:
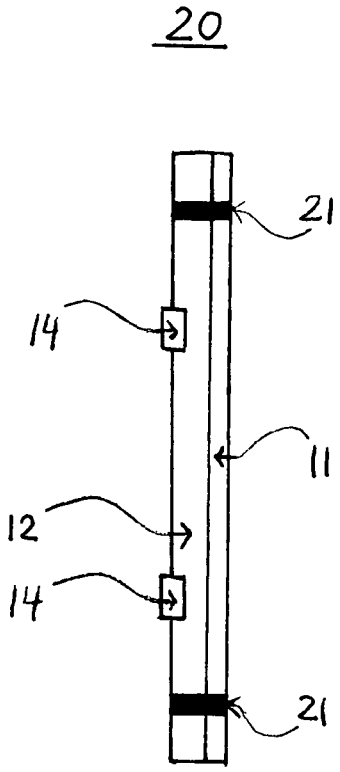
FIG. 5A and FIG. 5B are cutaway side views of the object-holding assembly 20 illustrating alternative embodiments of counter-attachment pieces 14.
Figure 5B:
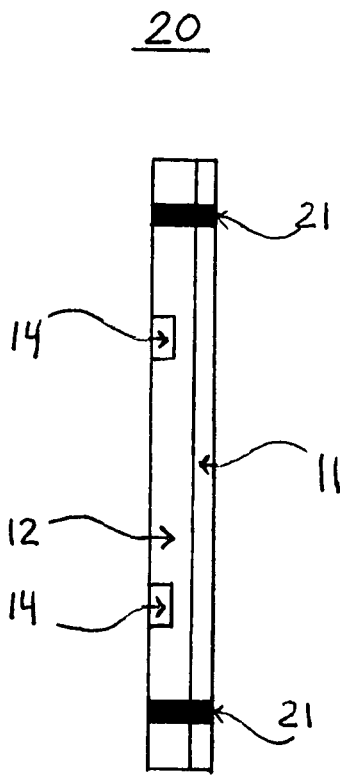

In one embodiment, the object-holding assembly includes one or more counter-attachment piece 14. In one example, the counter-attachment piece is attached to, or is part of the resting plate 12 of the object-holding assembly. In an exemplary embodiment, the counter-attachment piece is partially embedded into the resting plate 12, as illustrated in FIG. 5A. In another exemplary embodiment, the counter-attachment piece is fully embedded into the resting plate, as illustrated in FIG. 5B. In yet another example, the counter-attachment piece is embedded into the resting plate in order to facilitate the attachment of the counter-attachment piece to the surface of the resting plate (e.g., by glueing). In a further example, the counter-attachment piece is embedded into the resting plate to reduce the distance between the support surface of the base and the object-holding assembly, when the object-holding assembly is attached to the base.

In another exemplary embodiment, the counter-attachment piece is part of the holding device of the object-holding assembly. For example, a magnet or a piece of ferromagnetic metal is attached to a plastic clip. In another example, the holding device is made of a ferromagnetic material. For instance, the holding device is a metal clip or clasp, which can engage a magnet attached to the base.

A variety of methods may be used to attach the counter-attachment piece 14 to the object-holding assembly (e.g., the resting plate or the holding device). Selection of a suitable method may depend on the weight/size as well as the material of the involved parts. In an exemplary embodiment, in which both, the resting plate 12 and the counter-attachment piece are metal, the counter-attachment piece can be attached to the resting plate by means of soldering or welding. In another exemplary embodiment, the counter-attachment piece and the resting plate are connected using glue. Useful glues as well as other methods for attachment are discussed herein above in the context of attaching an attachment piece to the base.

III. Object-Holding Assembly (20)

Figure 2:
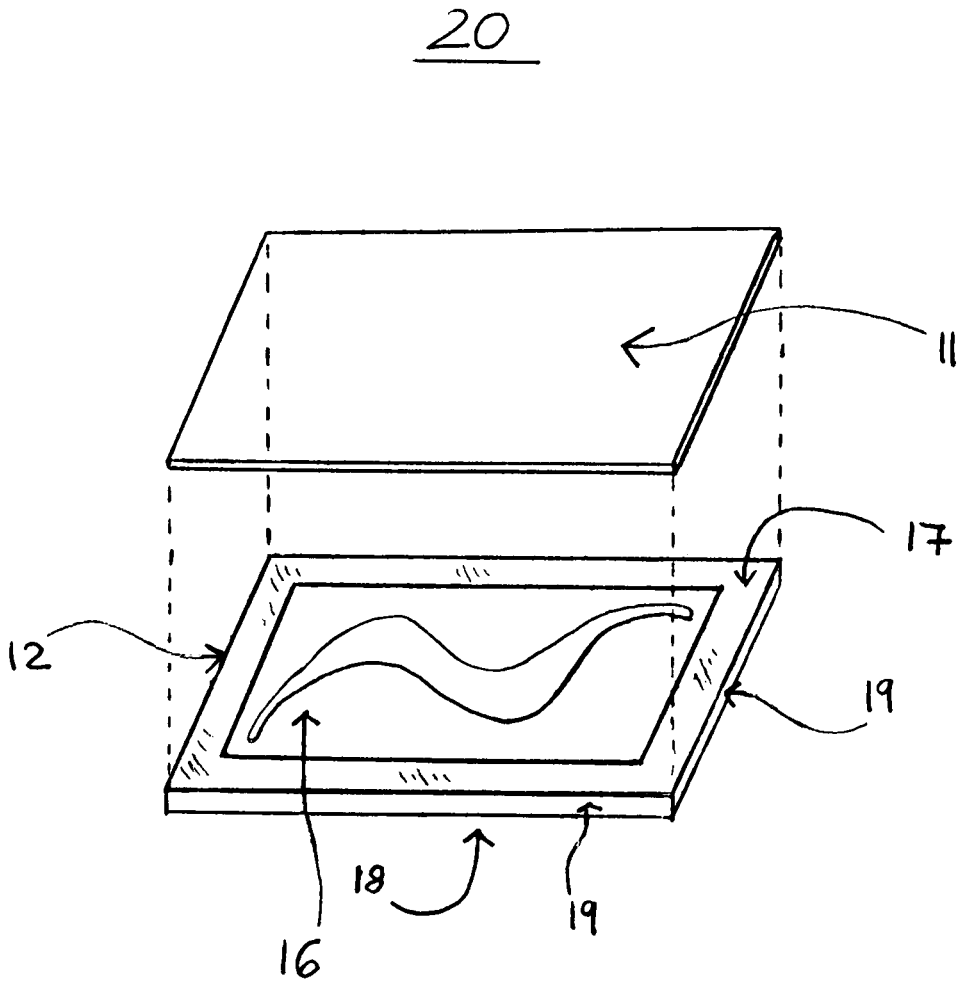
FIG. 2 illustrates the assembly of an exemplary object-holding assembly 20. The display object 16 is placed upon the support surface 17 of the resting plate 12. The cover plate 11 is then lowered onto the resting plate positioning the display object between the resting plate and the cover plate. In a subsequent step, one or more holding device (not shown) is attached to releasably attach the resting plate and the cover plate to each other.

In one example, the object-holding assembly 20 includes a cover plate 11, a resting plate 12 and one or more holding device 21. FIG. 2 illustrates the assembly of an exemplary object-holding assembly. When assembling the object-holding assembly, the display object 16 is placed between the resting plate 12 and the cover plate 11. One or more holding device 21 (not shown in FIG. 2) can be used to releasably attach the cover plate and the resting plate to each other thereby immobilizing the display object between the two plates.

Figure 9:
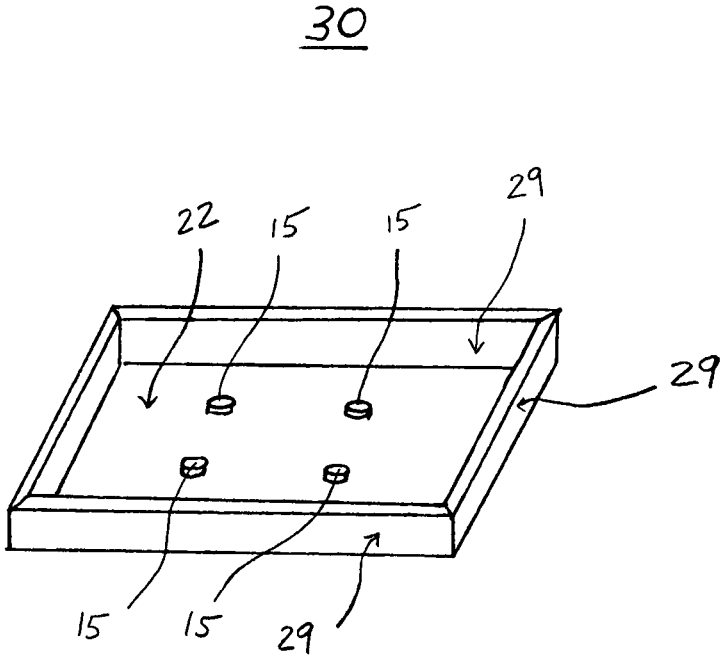
FIG. 9 is a top/side view of the base 30 illustrating an embodiment, in which the base includes four side panels forming a box-shaped frame.

The object-holding assembly can have any size. In one example, the object-holding assembly is larger than the base. In another exemplary embodiment, the object-holding assembly is smaller than the base. In one example, in which the base 30 has a box-like shape (e.g., as illustrated in FIG. 9), the dimensions of the object-holding assembly are such that one or more gap 32 is created between the outer edge of the object-holding assembly and a side panel of the base (e.g., illustrated in FIG. 10). In an exemplary embodiment, such gap allows the user to insert one or more finger between the resting plate and the support surface of the base and to pull the object-holding assembly away from the base, thereby disengaging the attachment piece and the counter-attachment piece.

Cover Plate (11)

The cover plate can have any size and can be made from any rigid or semi-rigid material. In one embodiment, the cover plate 11 is essentially transparent. In the context of this application, the term "transparent" means that an object is visible to a human viewer through the transparent plate. Transparent materials include those that create an optical effect (e.g., caused by a rough surface or tinting). Hence, the appearance of the display object as seen through the transparent cover plate may be altered when compared to its appearance without the plate.

In another embodiment, the cover plate includes a transparent portion, while other parts of the cover plate are non-transparent. In this embodiment, the cover plate can also function as a type of matting. In an exemplary embodiment, the transparent portion of the cover plate has a particular shape. Exemplary shapes may be selected from rectangular, square, triangular, circular, oval and heart-shaped. In another embodiment, the cover plate is a member selected from clear or tinted. In a preferred embodiment, the transparent cover plate is clear (e.g., conventional white glass or non-tinted, transparent acrylics).

In addition, the transparent portion of the cover plate can alternatively be a hole in the cover plate. Part of the display object may be exposed through the hole. Two or more holes may be used to simultaneously display several display objects or different parts of the same display object.

In one embodiment, the cover plate includes a material selected from metal, wood, glass, safety glass, polymers, woven materials, cardboard, multilayered paper, paper and combinations thereof. Exemplary polymers include Plexiglas, vinyl, acrylics, polystyrene, polycarbonate and any type of plastic. In a preferred embodiment, the cover plate is comprised of a material, which is characterized by high impact stability. In one example, the impact stability of the cover plate is larger than the impact stability of conventional glass of the same thickness. In another preferred embodiment, the cover plate is made of a material, which has a lesser weight than conventional glass of the same thickness. In one example, the cover plate is essentially made from a polymer, such as acrylic, polystyrene and polycarbonate. In a preferred embodiment, the polymeric material is clear and provides optical characteristics, which minimizes distortion of colors and shapes. In another preferred embodiment, the clear polymeric material minimizes the damage, which is typically inflicted on colors and dyes when exposed to light. In one example, the cover plate includes an optical coating, such as an anti-reflective coating (i.e., to reduce glare).

Resting Plate (12)

The resting plate 12 can be made from any material and can have any of the characteristics described herein for the cover plate. In one embodiment, the resting plate is made from a rigid material. In another embodiment, the resting plate includes a material selected from wood, metal, glass, safety glass, polymers, cardboard and combinations thereof. Exemplary polymers include Plexiglas, plastics, vinyl, acrylics, polystyrene and polycarbonate. In an exemplary embodiment, the resting plate includes one or more counter-attachment piece 14.

In one example, the resting plate is essentially transparent. In another example, the resting plate includes a transparent portion, while other parts of the resting plate are non-transparent. In a yet another example, the resting plate is non-transparent. In a further example, the resting plate is made from colored polymeric material, such as acrylics and polystyrenes, and optionally includes a surface pattern.

In one embodiment, the support surface 17 of the resting plate is adapted to minimize sliding of the display object 16 positioned between the resting plate 12 and the cover plate 11. Sliding may occur during assembly of the object-holding assembly. Downward sliding may be caused by gravity when the display system is in a vertical position. In one example, the resting plate 12 further includes on its support surface 17, display object-retaining means. Exemplary display object-retaining means include tack sheets, tack spray, release tape, double-sided tape, photo-corners, non-permanent adhesive material, and combinations thereof. In another example, the support surface of the resting plate includes an anti-slip or anti-slide coating, which are known in the art. Exemplary anti-slip or anti-slide coatings may employ a slightly rough surface or a rubber-like surface. In yet another example, the surface of the resting plate or the cover plate has a small elevated part, which applies localized pressure to the display object.

Holding Device (21)

In an exemplary embodiment, the resting plate 12 and the cover plate 11 of the object-holding assembly 20 are releasably attached to each other by one or more holding device 21. In an exemplary embodiment, each holding device is a member independently selected from the group consisting of clips, clamps, pegs, clasps, elastic bands, strings, straps, rivet fasteners (e.g., rivet nuts and snap rivets), pin fasteners (e.g., clevis pins and detent pins), latches, braces, hinges, corner casts, magnets, ferromagnetic material, screws, nuts and bolts, hook and loop fasteners (e.g., Velcro® and velcro-like material), elastic fasteners, hinges and reversibly adhesive material. Holding devices including bolts or screws are particularly useful for use with thicker display objects. When adapted accordingly, they can be used to adjust the distance between the resting plate and the cover plate. In one embodiment, such devices may be used to clamp the display object between the two plates.

The holding device can include any material, such as metal, plastics, wood and the like. In a preferred embodiment, the holding device is adapted to not damage (e.g., scratch) the surface of the resting- and/or cover plate. Hence, the holding device may inlcude a protective lining for those parts that regularly come in contact with the plates. The protective lining may be a rubber lining, a velvet lining or the like.

Figures 3A, 3B, 3C:
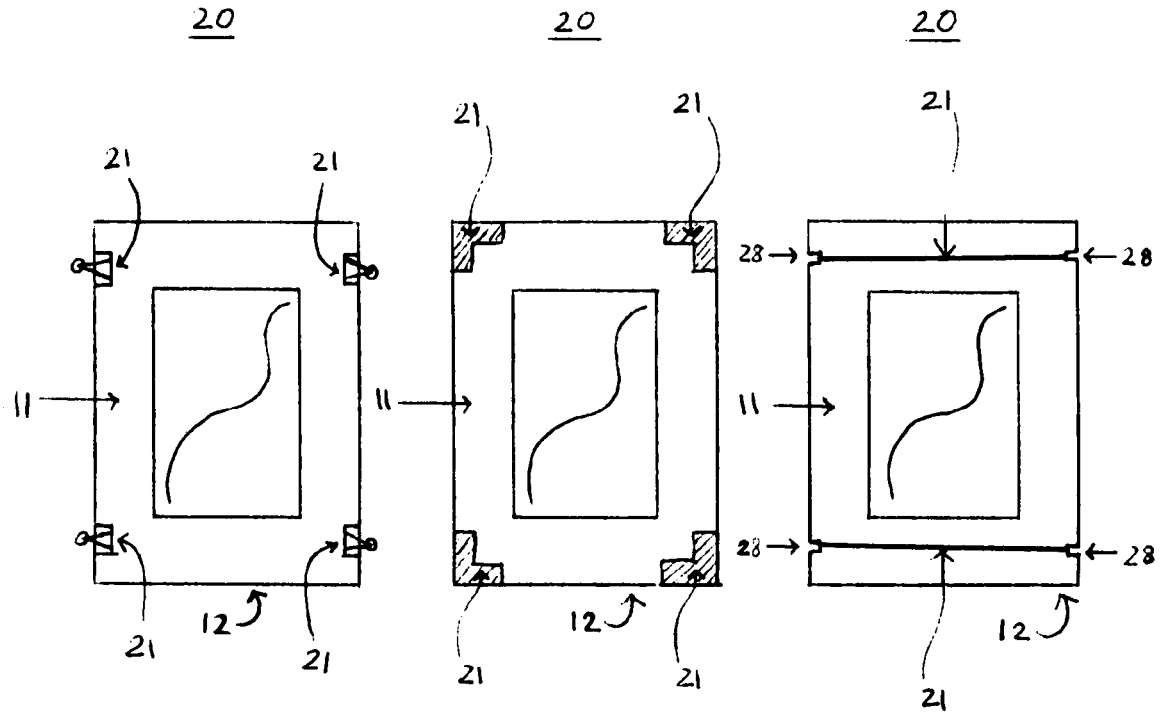
FIG. 3A through 3C are front-views of the object-holding assembly 20 and illustrate various embodiments of the holding device 21 (3A: clips, 3B: corner casts, 3C: elastic bands in combination with slits or grooves 28 located in the cover plate and the resting plate).

In one embodiment, in which the display system of the invention is adapted for use by children, each holding device 21 is preferably a member independently selected from clips, clasps, corner casts, and elastic bands. Exemplary embodiments are illustrated in FIG. 3A (clips), FIG. 3B (corner casts) and FIG. 3C (elastic bands). In a preferred embodiment, the holding device 21 is a clip. Exemplary clips are independently selected from binder clips, spring clips (e.g., a stationary-type spring clips) and the like. The clips can have any ornamental design.

In another embodiment, the holding device is a hinge, which is attached to both the resting plate and the cover plate. In one example, the resting plate and the cover plate are hingedly connected to each other alongside one edge by one or more hinge. The resulting object-holding assembly may be "opened and closed" for placement of the display object. In this embodiment, the object-holding assembly can include one or more holding device in addition to the one or more hinge.

In a further example, the holding device includes an elastic band. Elastic bands may be placed around the resting plate and the cover plate (e.g., as shown in FIG. 3C). In another example, the elastic band may be part of a fastener or closure, which is similar to an album fastener or album closure. In one example an elastic loop is attached to either the resting plate or the cover plate, while the respective other plate has a protrusion (e.g., in plane or perpendicular to the plate surface) over which the elastic loop can be placed. In another example, the elastic loop is attached to one of the plates and can be pulled over the corner area of the two plates, when the two plates are placed together.

Figure 6A:
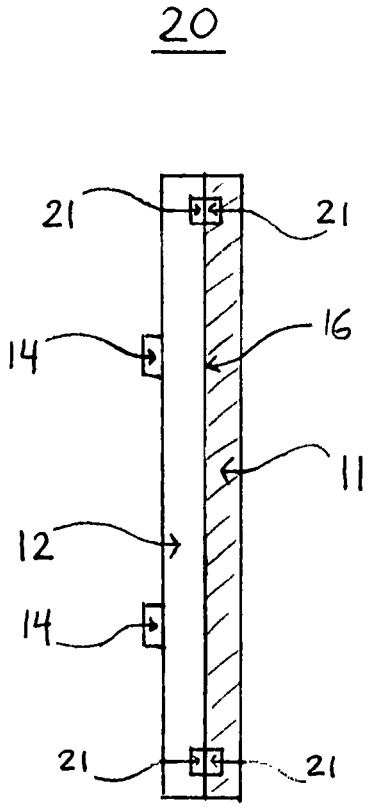
FIG. 6A and FIG. 6B are cutaway side views of the object-holding assembly 20 and illustrate an embodiment, in which holding devices 21 are selected from magnets and ferromagnetic metal and are embedded into the resting plate 12 and the cover plate 11, respectively.

In another exemplary embodiment, the holding devices 21 are selected from magnets and ferromagnetic material and are arranged so that the holding devices included in the resting plate 12 and the cover plate 11 can engage through magnetic force. In an exemplary embodiment, the holding device is embedded into the resting plate 12 and the cover plate 11 as illustrated in FIG. 6A. In another example, the holding devices 21 are placed at the outer perimeter of the cover plate 11 and the resting plate 12, so that the view of the display object is not obstructed when the display system 10 is fully assembled.

Figure 6B:
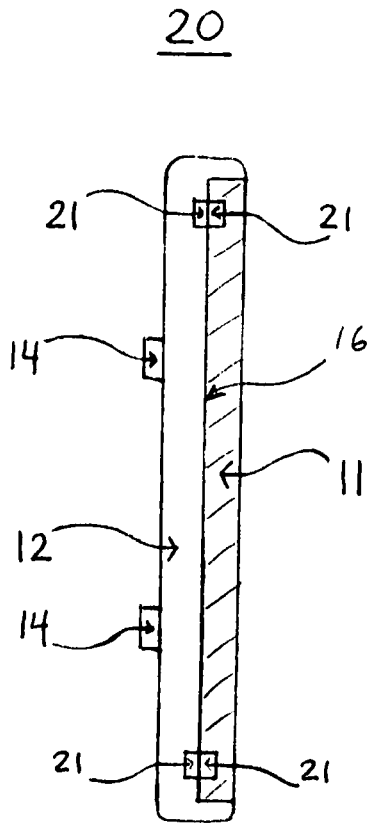
Figure 6C:
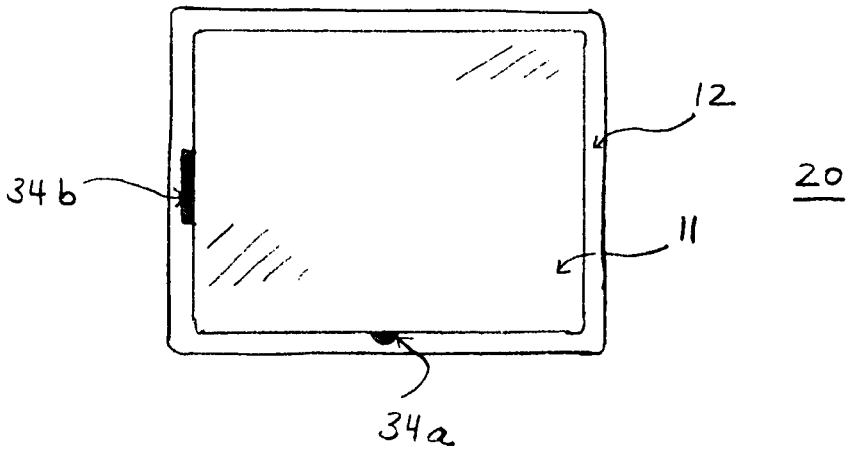
FIG. 6C is a front-view of the resting plate and the cover plate, wherein the cover plate is inserted into the resting plate. The resting plate in FIG. 6C shows exemplary removal aids 34 (groove 34*a* or slit 34*b*).

In yet another embodiment, one member selected from the resting plate and the cover plate has a shape, which provides an opening into which the other member can be inserted, optionally retaining a display object 16 between the plates. For example, the resting plate includes a flat opening, which accommodates the cover plate as shown in FIG. 6B and FIG. 6C. In one example, according to this embodiment, the resting plate and the cover plate include holding devices selected from magnets and ferromagnetic material as shown in FIG. 6B. In another example, the cover plate, once inserted, is retained inside the resting plate by frictional force between the two plates. In this example, the holding device is the frictional force. The plate that provides the opening, into which the other plate is inserted, is called the "receiving plate". In one example, the receiving plate (e.g., the resting plate in FIG. 6C) includes a removal aid 34, which is useful to aid in the release of the inserted plate (e.g., the cover plate in FIG. 6C) from the receiving plate. In another example, the removal aid is a member selected from a slit or groove, into which an object (such as the tip of a spoon) can be inserted to lift the inserted plate off the receiving plate. In another example the receiving plate has a hole, into which an object or a finger can be inserted to push the inserted plate out of the receiving plate. The hole is preferably positioned in the center area of the receiving plate.

Holding Aid (28)

In one embodiment, the resting plate 12 and/or the cover plate 11 further include one or more holding aid 28 adapted to receive at least one holding device 21. In an exemplary embodiment, each holding aid is a member independently selected from grooves, slits, protrusions, holes and the like. In one example, the holding device is an elastic band held in place by grooves, which are placed into the resting plate and the cover plate. In a preferred embodiment each holding aid 28 is positioned at the edges of the cover plate 11 and the resting plate 12 so that the view of the display object 16 is not obstructed. An exemplary embodiment according to this aspect is illustrated in FIG. 3C.

Display Object

In one embodiment, the display system of the invention includes a display object between the resting plate and the cover plate. The term "display object" means any object, which can be displayed using the display system of the invention. Exemplary "display objects" include artwork, such as paintings, drawings, collages, photographs and the like. The term also includes printed materials, such as tickets, menues, information pamphlets, certificates, sportscards, postcards and the like. The term "display object" further includes objects, such as coins and other memorabilia, which can optionally be placed onto a soft carrier material, such as foam. The "display object" optionally includes matting. The matting can be any commercial or custom-made matting. In an exemplary embodiment the matting is a member selected from paper, plastic foil, cardboard and matting board.

The "display object" can optionally include object-retaining means useful to prevent movement of the display object between the resting plate and the cover plate. Exemplary object retaining means include tack sheets, tack spray, release tape, photo-corners, non-permanent adhesive material, and combinations thereof. In one embodiment, object retaining means are used to keep the display object from sliding (e.g., downwards caused by gravity). In one embodiment, object-retaining means are used to keep the display object properly positioned when the cover plate is placed on top of the display object.

The "display object" can be a thin object (e.g., paper or photopaper), but can also have significant thickness. For example, a painting painted on stretched canvas may be several centimeters thick. In another embodiment, the object-holding assembly does not include a cover plate and the display object is attached to the resting plate using, for example, a holding device of the invention or another fastening mechanism. In one example according to this embodiment, the display object has smaller dimensions than the resting plate. In another example, the display object has larger dimensions than the resting plate.

Spacer

Figure 4:
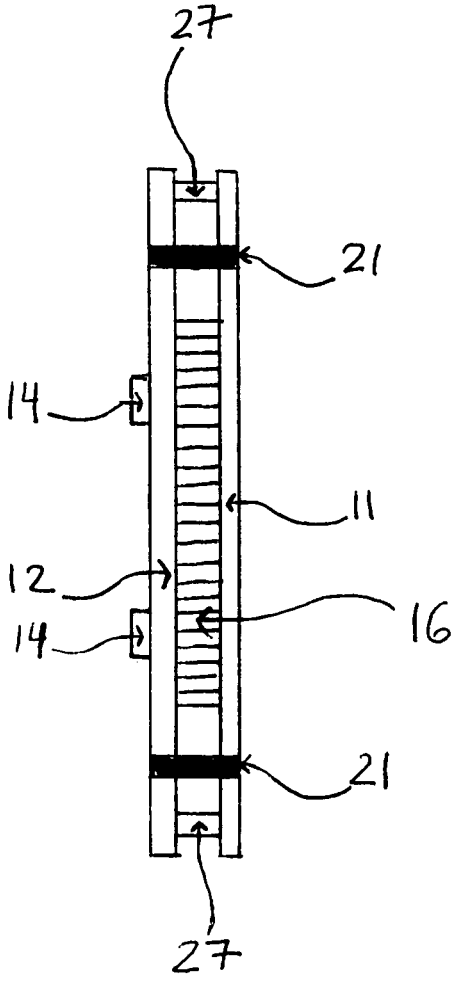
FIG. 4 is a cutaway side view of an exemplary object-holding assembly 20 and illustrates an embodiment in which spacers 27 are used between the resting plate 12 and the cover plate 11 to accommodate a substantially three-dimensional display object 16.

In one embodiment, the object-holding assembly 20 further includes one or more spacer 27 between the cover plate 11 and the resting plate 12. An exemplary arrangement is illustrated in FIG. 4. In an exemplary embodiment, the spacer 27 is used when the dimension of the display object 16 (e.g., artwork that includes objects) creates a gap between the resting plate and the cover plate. For example, spacers are useful when the holding devices 21 pull the two plates towards each other, which may eventually cause distortion or bending of the cover plate 11 and/or the resting plate 12. In a preferred embodiment, the spacer 27 is positioned at, or close to, the outer perimeter of the plates. In another exemplary embodiment, each spacer 27 is a member independently selected from rigid or semi-rigid material, such as wood, cardboard, plastic, rubber and the like. In another exemplary embodiment, the spacer is removably (e.g., through removably adhesive material) or permanently attached to at least one of the cover plate or the resting plate. In one embodiment, the spacer is part of a holding device. For example, corner casts or clips may include a centerpiece, which inserts between the resting plate and the cover plate, holding the two plates in a distance (i.e., when holding devices are attached).

IV. Base (30)

The base 30 of the display system 10 includes a support surface 22 and a rear surface 23, separated by a side edge 24, and optionally includes one or more attachment piece.

The base 30 can include any material and is preferably comprised of corrosion-resistant rigid material. In an exemplary embodiment, the base includes a material selected from wood, polymers, composites, metal (e.g., corrosion resistant metal, such as aluminum), coated metal and combinations thereof. Exemplary polymers include Plexiglas, vinyl, acrylics, polystyrene, polycarbonate and other plastics. It is well within the abilities of a skilled person to select a suitable base material depending on parameters, such as required stability, required size as well as type and intensity of use. In a preferred embodiment, the base is essentially made of a member selected from woods and polymeric material, such as acrylics.

In an exemplary embodiment, the base 30 has the shape of a box, for example as illustrated in FIG. 9. In this embodiment, the base includes 4 side panels 29 protruding in an angle (preferably a 90° angle) from the back panel creating a box-like frame (see e.g., FIG. 1, FIG. 7 and FIG. 9). In one example according to this embodiment, the back panel is substantially flat. In another exemplary embodiment, the object-holding assembly 20, when attached to the base 30 rests on the lower side panel 29. This embodiment is particularly useful when the object-holding assembly is comparatively large and/or heavy. In this embodiment, the holding force between the attachment pieces 15 and the counter-attachment pieces 14 may be sufficient to keep the object-holding assembly 20 upright and attached to the base 30, but may not be sufficient to prevent the object-holding assembly 20 from sliding downwards, caused by gravity.

Mounting Device

In an exemplary embodiment, the base 30 includes one or more mounting device for mounting the base to a vertical or horizontal mounting surface. In one embodiment, the base includes a mounting device useful to keep the display system in an essentially upright position when placed on a horizontal mounting surface, such as a tabletop. For example, the base may include a hinged-leg or support stand (e.g., attached to the rear surface of the base). Such devices are known in the art. In another exemplary embodiment the base includes one or more mounting device useful for mounting the base to a vertical mounting surface, such as a wall. In an exemplary embodiment, the mounting device is attached to the rear surface 23 of the base. In another exemplary embodiment, the mounting device is attached to the side edge 24 of the base. In a further exemplary embodiment the mounting device is attached to a side panel 29 of the base.

The mounting device can be any mounting device known in the art. In an exemplary embodiment, each mounting device is a member independently selected from mounting holes (e.g., for receiving screws, nails, picture hangers, bolts and the like), sawtooth hangers, mounting bars, loops (e.g., metal loops), strings (e.g., plastic string), wire, receiving pieces, and combinations thereof. The term "receiving piece" means any device other than a hole driven into the base, which is especially adapted to accommodate picture hanging equipment, such as nails, screws, hooks and hangers. In one example, the receiving piece is a device, preferably made from a hard polymer or metal, which is attached to the base and is adapted to receive a body of rigid material, which is placed at the end of a string or wire. The string or wire may be attached to the wall or ceiling. The body of rigid material can, for example, be a small cylinder, sphere or cube made of metal or plastic. Such hanging devices are known in gallery- or museum-style picture hanging. Another mounting device is described in U.S. Patent Application 2001/0038061, which may be used to fasten a display system of the invention to a pinboard or the like.

Supporting Device (31)

In one embodiment, the base 30 further comprises one or more supporting device 31 for supporting the weight of the object-holding assembly 20, when the object-holding assembly is attached to the base and the display system 10 is in an upright position (e.g, mounted to a vertical mounting surface). In this embodiment, the lower edge of the object-holding assembly rests on the supporting device. In one example, the supporting device is used to hold the object-holding assembly in place when the fastener is not sufficiently strong as to prevent the object-holding assembly from slowly sliding downwards, caused by gravity.

Figure 10:
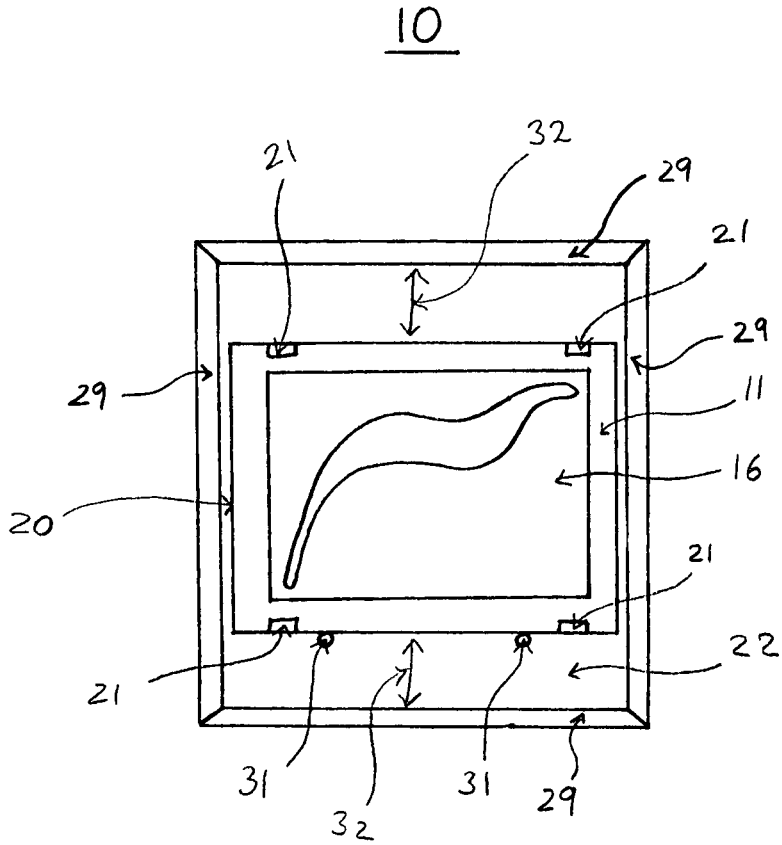
FIG. 10 is a front view of the display system 10 illustrating an embodiment of the base 30 in which the base includes supporting devices 31. The figure further illustrates an embodiment of the display system 10, in which the dimensions of the object-holding assembly 20 are smaller than the dimensions of the base 30, creating gaps 32 between the object-holding assembly 20 and the side panels 29 of the base.

Supporting devices are particularly useful when the dimensions of the object-holding assembly 20 are smaller than the dimensions of the base and the object-holding assembly cannot rest on a lower side panel 29 of the base. This can be the case, for instance, when the lower part of the base 30 extends beyond the boundaries of the picture holding assembly creating a gap 32, as illustrated in FIG. 10. In an exemplary embodiment, each supporting device 31 is a member independently selected from pins, hooks or any other type of protrusion (e.g., a wood or metal bar) attached to the support surface or a side panel of the base.

It is understood that the examples and embodiments described herein are for illustrative purposes only and that various modifications or changes in light thereof will be suggested to persons skilled in the art and are to be included within the scope of this application and scope of the appended claims. All publications, patents, and patent applications cited herein are hereby incorporated by reference for all purposes.

What is claimed is:

1. A display system comprising:

(a) a base having a rear surface and an opposing support surface and at least one side panel protruding in an angle from said support surface;

(b) an object-holding assembly including:

(i) a cover plate;

(ii) a resting plate having a support surface and an opposing rear surface; and (iii) at least one holding device for releasably attaching said cover plate to said resting plate; and (c) a fastener for releasably attaching said object-holding assembly to said base, said fastener comprising at least two magnetic fasteners substantially spaced from each other, each of said magnetic fasteners including an attachment piece attached to said base and a counter-attachment piece attached to said object-holding assembly, wherein each attachment piece and each counter-attachment piece comprises a member independently selected from magnets and ferromagnetic materials, wherein said attachment pieces and said counter-attachment pieces releasably engage through magnetic force when said object-holding assembly is attached to said base, wherein the display system comprises at least one gap between said object-holding assembly and said at least one side panel, said gap sufficient for a user to insert one or more finger between said resting plate and said support surface of said base in order to pull said object-holding assembly away from said base thereby disengaging said attachment pieces and said counter-attachment pieces.

2. The display system of claim 1, further comprising a display object positioned between said resting plate and said cover plate.

3. The display system of claim 1, wherein at least one of said attachment pieces is attached to said support surface of said base.

4. The display system of claim 1, wherein said at least one holding device of said object-holding assembly comprises at least one of said counter-attachment pieces.

5. The display system of claim 1, wherein said resting plate of said object-holding assembly further comprises at least one of said counter-attachment pieces.

6. The display system of claim 5, wherein at least one of said counter-attachment pieces is attached to said rear surface of said resting plate.

7. The display system of claim 1, further comprising a mounting device for mounting said base to a vertical or horizontal mounting surface.

8. The display system of claim 1, wherein said object-holding assembly further comprises a spacer between said cover plate and said resting plate.

9. The display system of claim 1, wherein said cover plate is essentially transparent.

10. The display system of claim 1, wherein said cover plate comprises a transparent portion.

11. The display system of claim 1, wherein said cover plate comprises a material selected from the group consisting of metal, wood, glass, Plexiglas, plastics, vinyl, acrylics, polystyrene, polycarbonate, safety glass, woven materials, cardboard, multi-layered paper, plastic foil and combinations thereof.

12. The display system of claim 1, wherein said resting plate comprises a material selected from the group consisting of wood, metal, glass, Plexiglas, plastics, vinyl, acrylics, polystyrene, polycarbonate, safety glass, cardboard and combinations thereof.

13. The display system of claim 1, wherein at least one member selected from said resting plate and said cover plate further comprises one or more attachment aid to facilitate attachment of said holding device.

14. The display system of claim 13, wherein each of said attachment aid is a member independently selected from grooves, slits, holes and protrusions.

15. The display system of claim 1, wherein each of said holding device is a member independently selected from the group consisting of clips, clamps, pegs, clasps, elastic bands, strings, straps, rivet fasteners, pin fasteners, screws, latches, braces, hook and loop fasteners, elastic fasteners, hinges, corner casts, nuts and bolts, magnets and ferromagnetic material.

16. The display system of claim 15, wherein said clips are members independently selected from the group consisting of binder clips and spring clips.

17. The display system of claim 1, wherein said base comprises a rigid material selected from the group consisting of wood, corrosion-resistant metal, coated metal, plastics, Plexiglas, composites, vinyl, acrylics, polystyrene, polycarbonate, and combinations thereof.

18. The display system of claim 1, wherein said base comprises four side panels forming a box-shaped frame.

19. The display system of claim 18, wherein said object-holding assembly rests on a side panel when said display system is in an upright position.

20. The display system of claim 1, wherein said base further comprises one or more supporting device for supporting weight of said object-holding assembly when said display system is in an upright position.

21. The display system of claim 1, wherein each of said magnetic fasteners comprises an attachment piece attached to said support surface of said base and a counter-attachment piece attached to said rear surface of said resting plate.

22. The display system of claim 1, wherein each of said magnetic fasteners comprises a magnetic snap fastener.

* * * * *